US005413324A

United States Patent [19]

Flade

[11] Patent Number: 5,413,324

[45] Date of Patent: May 9, 1995

[54] SHEET DELIVERY FOR A SHEET-PROCESSING MACHINE

[75] Inventor: Gregor Flade, Meckesheim, Germany

[73] Assignee: Heidelberger Druckmaschinen AG, Heidelberg, Germany

[21] Appl. No.: 198,851

[22] Filed: Feb. 17, 1994

[30] Foreign Application Priority Data

Feb. 17, 1993 [DE] Germany ..... 43 04 841.2

[51] Int. Cl.[6] ..... B65H 31/00

[52] U.S. Cl. ..... 271/218; 271/204; 414/789.3; 414/790.8

[58] Field of Search ..... 271/204, 213, 214, 215, 271/218, 219; 414/790.8, 789.3, 791

[56] References Cited

U.S. PATENT DOCUMENTS

| | | | |
|---|---|---|---|
| 2,010,732 | 8/1935 | Mandusic | 271/218 |
| 3,418,895 | 12/1968 | Palmer | 271/218 |
| 3,479,932 | 11/1969 | Stal et al. | 271/218 |
| 3,902,711 | 9/1975 | Lenoir . | |
| 5,226,641 | 7/1993 | Schieleit | 271/215 |

FOREIGN PATENT DOCUMENTS

| | | |
|---|---|---|
| 1231721 | 7/1967 | Germany . |
| 3028865 | 2/1982 | Germany . |
| 4114096 | 11/1992 | Germany . |
| 63-41359 | 2/1988 | Japan . |
| 391743 | 9/1965 | Switzerland . |

*Primary Examiner*—H. Grant Skaggs
*Attorney, Agent, or Firm*—Herbert L. Lerner; Laurence A. Greenberg

[57] ABSTRACT

Sheet delivery for a sheet-processing machine having a conveyor with a device for releasing conveyed sheets horizontally oriented on a displaceable base support above an auxiliary sheet pile, includes a device for inserting a plurality of base members as intermediate pile supports in a successive sequence opposite to a conveying direction of the sheets into respective gaps between sheets of respective pairs of the sheets, and a device including a guide for guidingly swiveling the intermediate pile supports together with a respective auxiliary pile accumulated thereon through an angle of 90° into a main pile position wherein the sheets stand edgewise on a side edge thereof, and the intermediate pile supports are vertically withdrawable.

6 Claims, 2 Drawing Sheets

SHEET DELIVERY FOR A SHEET-PROCESSING MACHINE

SPECIFICATION

Figure 1:
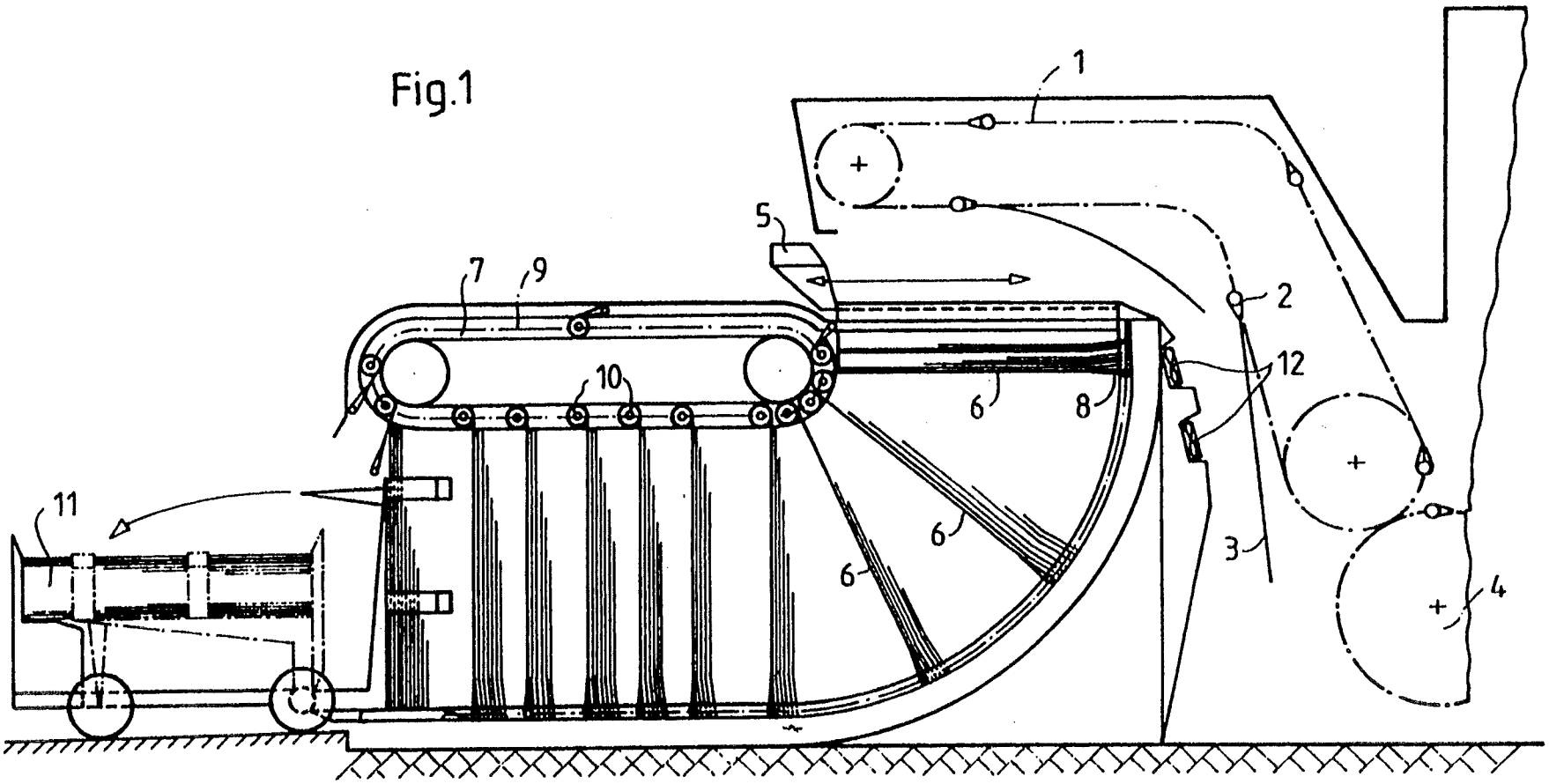

The invention relates to a sheet delivery for a sheet-processing machine and, more particularly, a printing machine or press for offset printing wherein a conveyor releases sheets on a displaceable base support i37n a horizontal orientation above an auxiliary sheet pile. Conventional equipment of the foregoing general type having the aforedescribed features has become known heretofore from German Patent 12 31 721. Described therein is an intermediate stacker or piling device for transiently or transitorily receiving sheets oncoming in a delivery for a so-called non-stop pile exchange, wherein a lattice table is introducible in the transport direction of the oncoming sheets for accumulating sheets thereon transitorily or temporarily so that the sheet pile can be exchanged without interrupting the press operation. This lattice table is withdrawn after the pile exchange and rolled up in a position in front of the pile space.

An intermediate pile device for a so-called non-stop pile exchange in a sheet delivery for a horizontal deposit of sheets has become known heretofore :from German Published Non-Prosecuted Patent Application (DE-OS) 30 28 865. In accordance therewith, an auxiliary pile support is formed of a roll blanket or shutter stretched over carrier tubes and reversibly drivable in guide rails, angle rails being arranged flappably fastened to the guide rails, and intermediate pile boards for forming individual intermediate piles of relatively low height being insertable into the angle rails. The sheets to be delivered are initially deposited on the roll blanket and then, after the intermediate pile board has been inserted, transferred by the roll blanket onto intermediate pile board. The roll blanket is inserted, in transport or conveying direction of the sheets, from a storage roll arranged in front of the pile space, into a gap between two of the sheets, so that the auxiliary pile board can be fed in below the roll blanket in a direction opposite to the sheet transport or conveying direction.

In both of the hereinaforementioned conventional devices, the main sheet pile is formed horizontally, so that the sheets become packed in a sheet pile disposed in a horizontally oriented plane.

Heretofore known from German Published Non-Prosecuted Patent Application (DE-OS) 27 21 441 is a sheet piler or stacking device in a sheet delivery, wherein oncoming sheets between belts of a transport system are transferred with a sharp sheet bend into a vertical orientation, the upward bending trailing edge of a preceding sheet permitting the leading edge of the succeeding sheet to slide thereunder and thereby achieving a shingle or stream form, due to which the sheets, at the vertical inlet into the sheet pile, are mutually displaced, sliding on one another. In the main pile, the sheets are disposed edgewise, resting on a side edge thereof.

A device for setting up or straightening out sheets from a horizontal position into a vertical position has become known heretofore from German Published Non-Prosecuted Patent Application (DE-OS) 41 14 096, however, no pile formation occurs thereby.

It is an object of the invention to provide a sheet delivery for a sheet-processing machine having the features noted in the introduction hereto, so that horizontally oncoming sheets standing vertically on a side edge thereof, preferably become packed with time delay into a sheet pile, which permits the removal of subpiles during normal machine operation. A construction is especially striven for, which is suited for use as an auxiliary device on an existing sheet delivery for a horizontal sheet layout.

With the foregoing and other objects in view, there is provided, in accordance with the invention, a sheet delivery for a sheet-processing machine having a conveyor with means for releasing conveyed sheets horizontally oriented on a displaceable base support above an auxiliary sheet pile, comprising means for inserting a plurality of base members as intermediate pile supports in a successive sequence opposite to a conveying direction of the sheets into respective gaps between sheets of respective pairs of the sheets, and means including a guide for guidingly swiveling the intermediate pile supports together with a respective auxiliary pile accumulated thereon through an angle of 90° into a main pile position wherein the sheets stand edgewise on a side edge thereof, and the intermediate pile supports are vertically withdrawable.

In such a sheet delivery, the horizontally oncoming sheets are assembled or accumulated into small subpiles of a few sheets on the intermediate pile support and then swiveled through an angle of 90° into a vertical position wherein the sheets stand sidewise on a side edge thereof with the planar surfaces thereof oriented vertically. Only in this vertical position, does a thicker packing of the sheets occur so as to form a compact sheet pile which is able to be transported away in subpiles independently of the operation of the sheet-processing machine. A result of this construction, furthermore, is that, for example, freshly processed sheets, especially printed in a high-quality process, in spite of continual operation, are packed only with considerable time delay in a sheet pile transportable over very lengthy distances.

Of particular importance is the advantage that the features according to the invention are able to be realized in a special aggregation which can be combined with a conventional sheet delivery for horizontal sheet layout or deposit. It is possible thereby to make use of the features according to the invention also afterwards for existing machines with a delivery for horizontal sheet deposit.

In accordance with another feature of the invention, means are provided for guiding the intermediate pile supports at respective opposite sides thereof at which leading and trailing edges of the sheets are disposed, and means are provided for driving the intermediate pile supports so as to compensate for a difference in travel path length of the respective opposite sides of the intermediate pile supports resulting from the swivel angle.

In accordance with a further feature of the invention, the intermediate pile supports are formed of material capable of being rolled up, and means are included for unrolling the rolled-up intermediate pile supports when the intermediate pile supports are inserted by the inserting means into a stretched intermediate pile position thereof.

In accordance with an added feature of the invention, respective entrainers are disposed at the side of the intermediate pile supports at which the leading edge of the sheets is disposed, and spring means are included opposing the rolling-up of the intermediate pile supports and cooperating with the inserting means for inserting the intermediate pile supports in the intermediate pile position through the respective gap between sheets of the respective pairs of sheets and into the entrainer, the entrainer being displaceably drivable in the guide means at the side of the intermediate pile supports opposite to the side thereof at which the leading edge of the sheets is disposed.

In accordance with an additional feature of the invention, the sheet delivery includes transport means for the rolled-up intermediate pile supports and transport means for the entrainers, both of the transport means being endlessly revolvingly guidable and being drivable at varying speed to compensate for a difference in length of travel path thereof resulting from the swivel angle.

In accordance with a concomitant feature of the invention, at least one of the transport means is a toothed belt. Other features which are considered as characteristic for the invention are set forth in the appended claims.

Although the invention is illustrated and described herein as embodied in a sheet delivery for a sheet-processing machine, it is nevertheless not intended to be limited to the details shown, since various modifications and structural changes may be made therein without departing from the spirit of the invention and within the scope and range of equivalents of the claims.

Figure 2:
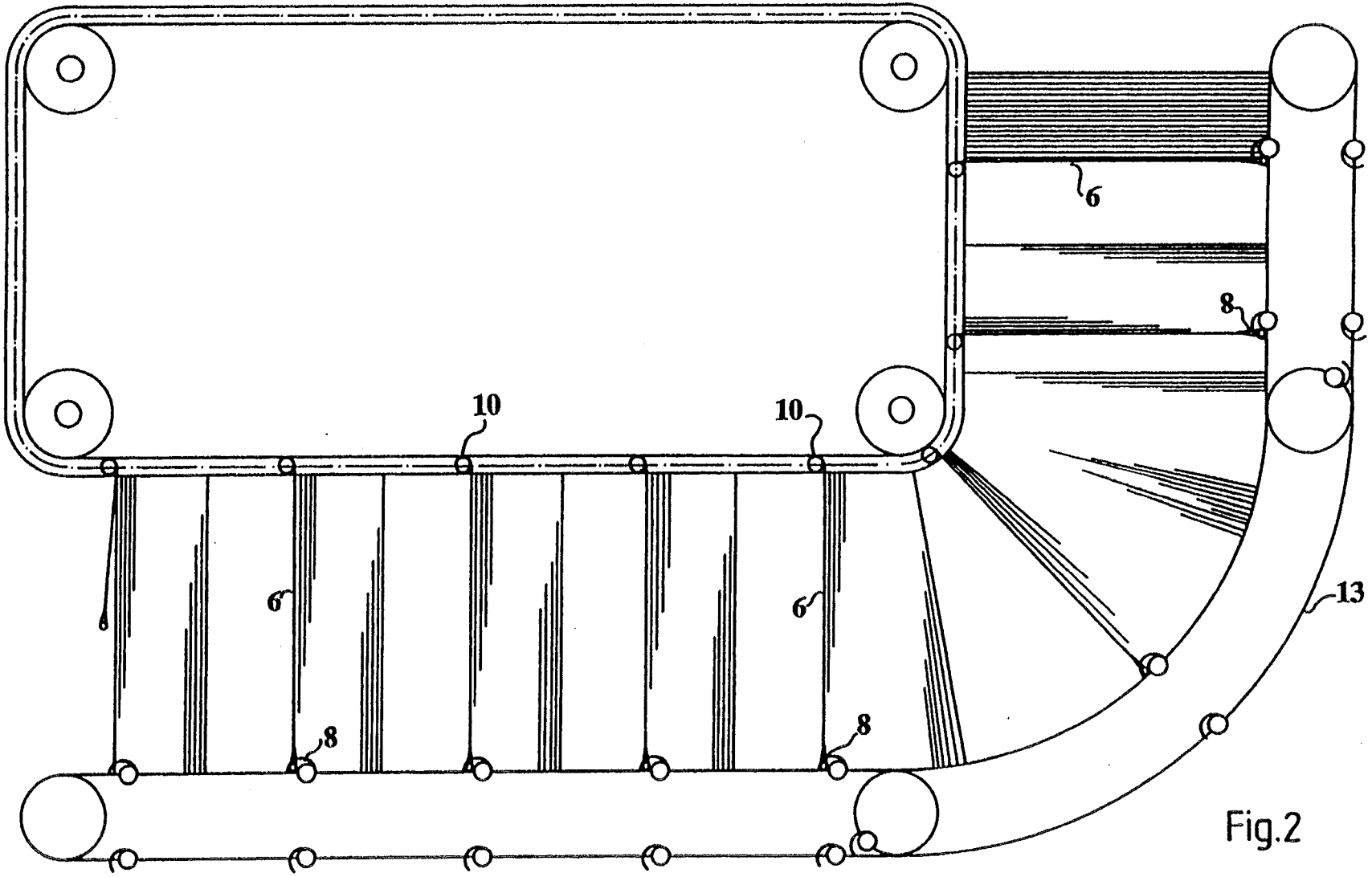

The construction and method of operation of the invention, however, together with additional objects and advantages thereof will be best understood from the following description of specific embodiments when read in connection with the accompanying drawings, in which:

FIG. 1 is a diagrammatic side elevational view of a sheet-processing machine, such as a sheet-fed rotary offset printing press, embodying the sheet delivery according to the invention; and FIG. 2 is a somewhat enlarged view like that of FIG. 1 of another embodiment of the invention.

Referring now to the drawings and, first, particularly to FIG. 1 thereof, there is shown therein an embodiment of the sheet delivery according to the invention in a sheet-fed rotary offset printing press. A chain conveyor 1 with grippers 2 fastened to endlessly revolving chains grip sheets 3 at a leading edge thereof and transport them from, for example, an impression cylinder 4 into a horizontal release position, wherein the grippers 2 open and release the sheets 3, so that the leading edge thereof strikes against a horizontally adjustable guide plate 5 and the sheets 3 drop downwardly.

In an advantageously separate frame, several intermediate pile supports 6 formed of material which is able to be rolled up, for example, sheetmetal, plastic material, textile material, or the like, are arranged so that they are insertable horizontally, in a direction opposite to the conveying direction of the sheets 3, into gaps between respective pairs of the oncoming sheets 3. These intermediate sheet pile supports 6 are endlessly revolvingly guided in a guide 7 and are connected to a drive which is controllable independently of the press speed. The intermediate pile supports 6 are inserted in succession in a direction opposite to the conveying direction of the oncoming sheets 3 for the purpose of forming intermediate sheet piles having relatively low heights, until an entrainer 8 at the opposite side grips the leading edge of the intermediate pile support 6. This entrainer 8 is seated on a conveyor, for example an endlessly revolving chain 9, which is driven with a thrust or throw differing from that of the drive of the intermediate pile support in the guide 7, in order to permit the swiveling movement of the stretched intermediate pile support 6 through an angle of 90° out of the horizontal position and into the vertical position. The intermediate pile supports 6 are released from the entrainer 8 on the chain 9 at a predetermined location and withdrawn into a rolled storage position. In addition thereto, it is advantageous, when inserting the intermediate pile supports 6 into the gaps between respective pairs of the sheets 3, to use the action of a spring which has been loaded or stressed beforehand, for example, when rolling up the intermediate pile supports 6, so that the loaded spring shoots the intermediate pile supports 6 into the gaps between the respective pairs of sheets 3. With the release of the intermediate pile supports 6 by the entrainers 8, the intermediate pile supports 6 are withdrawn into the storage roll 10 by suitable drive means. Only after the intermediate pile supports 6 have been drawn out, does the final packing of the pile occur, in that the sheets are then oriented with the planar surfaces thereof extending vertically and resting with a side edge thereof on a lower guide which, if necessary or desirable, has suitable thrust means, such as the endless conveyor system 13 of the embodiment of FIG. 2, which otherwise generally conforms with the embodiment of FIG. 1. Indeed, like features in both figures are identified by the same reference numerals. The packed pile can be transported away in subquantities, for example, by means of a driverless transport system 11. In the device according to the invention, only a few superimposed sheets are displaced on a relatively long swivel path out of the horizontal position and into the vertical position and then, without any packing worthy of mention are transported farther, so that the final packing of the sheets into a pile occurs only after a considerable time delay. On this transport path, additional means for sheet processing, for example, warm or hot air nozzles or the like, can be actuated in order to ensure that a mutual sheet contact under a loading occurs only if it does not impair the sheet quality. Blowers or fans 12 are provided for drying and for simultaneously guiding the sheets 3 by means of an air flow or current which is effective even before the sheets have reached the delivery position thereof.

I claim:

1. Sheet delivery for a sheet-processing machine having a conveyor with means for releasing conveyed sheets horizontally oriented on a displaceable base support above an auxiliary sheet pile, comprising means for inserting a plurality of base members as intermediate pile supports in a successive sequence opposite to a conveying direction of the sheets into respective gaps between sheets of respective pairs of the sheets, and means including a guide for guidingly swiveling said intermediate pile supports together with a respective auxiliary pile accumulated thereon through an angle of 90° into a main pile position wherein the sheets stand edgewise on a side edge thereof, and said intermediate pile supports are vertically withdrawable.

2. Sheet delivery according to claim 1, means for guiding said intermediate pile supports at respective opposite sides thereof at which leading and trailing edges of the sheets are disposed, and means for driving said intermediate pile supports so as to compensate for a difference in travel path length of the respective opposite sides of said intermediate pile supports resulting from said swivel angle.

3. Sheet delivery according to claim 1, wherein said intermediate pile supports are formed of material capable of being rolled up, and said inserting means include means for unrolling the rolled-up intermediate pile supports when the intermediate pile supports are inserted by said inserting means into a stretched intermediate pile position thereof.

4. Sheet delivery according to claim 3, wherein respective entrainers are disposed at the side of said intermediate pile supports at which the leading edge of the sheets is disposed, and said unrolling means include spring means opposing the rolling-up of said intermediate pile supports for inserting said intermediate pile supports in the intermediate pile position through the respective gap between sheets of the respective pairs of sheets and into said entrainer, said entrainer being displaceably drivable in said guide means at the side of said intermediate pile supports opposite to said side thereof at which the leading edge of the sheets is disposed.

5. Sheet delivery according to claim 4, including transport means for the rolled-up intermediate pile supports and transport means for said entrainers, both of said transport means being endlessly revolvingly guidable and being drivable at varying speed to compensate for a difference in length of travel path thereof resulting from said swivel angle.

6. Sheet delivery according to claim 5, wherein at least one of said transport means is a toothed belt.

* * * * *